United States Patent [19]

Shinoki et al.

[11] Patent Number: 4,929,528

[45] Date of Patent: May 29, 1990

[54] COATED CARRIER FOR DEVELOPER

[75] Inventors: Masayoshi Shinoki; Masahiro Takagi; Ikutaroh Nagatsuka; Koichi Kumashiro; Takayoshi Aoki; Masayuki Takeda, all of Kanagawa, Japan

[73] Assignee: Fuji Xerox Co., Ltd., Tokyo, Japan

[21] Appl. No.: 267,882

[22] Filed: Nov. 7, 1988

[30] Foreign Application Priority Data

Nov. 5, 1987 [JP] Japan ..... 62-278362
Nov. 5, 1987 [JP] Japan ..... 62-278363

[51] Int. Cl.[5] ..... G03G 9/14

[52] U.S. Cl. ..... 430/108; 428/407; 430/106.6

[58] Field of Search ..... 430/108, 106.6; 428/407

[56] References Cited

U.S. PATENT DOCUMENTS

| | | | |
|---|---|---|---|
| Re. 31,907 | 6/1985 | Poirer | 428/407 X |
| 3,798,167 | 3/1974 | Kukla et al. | 252/62.1 |
| 3,992,382 | 11/1975 | Kukla e al. | 427/58 |
| 4,147,834 | 4/1979 | Munzel et al. | 428/407 |
| 4,297,427 | 10/1981 | Williams et al. | 430/108 |
| 4,614,700 | 9/1986 | Yamamoto et al. | 430/108 |
| 4,725,521 | 2/1988 | Shigeta et al. | 430/108 |
| 4,810,611 | 3/1989 | Ziolo et al. | 430/106.6 |

FOREIGN PATENT DOCUMENTS

| | | |
|---|---|---|
| 47-13954 | 7/1972 | Japan . |
| 54-158932 | 12/1979 | Japan . |
| 56-11461 | 2/1981 | Japan . |
| 58-209753 | 12/1983 | Japan . |

*Primary Examiner*—Paul R. Michl
*Assistant Examiner*—Jeffrey A. Lindeman
*Attorney, Agent, or Firm*—Finnegan, Henderson, Farabow, Garrett and Dunner

[57] ABSTRACT

A carrier for a developer comprising a core material coated with a coating material consisting essentially of a copolymer of vinylidene fluoride and trifluoroethylene or hexafluoropropylene is disclosed. The carrier causes neither fog generation in the initial stage of running nor contamination of a developing machine because of its high rate of charge increase and satisfactory resistance to surface contamination, and exhibits excellent adhesion between the core material and the coating material.

13 Claims, No Drawings

COATED CARRIER FOR DEVELOPER

FIELD OF THE INVENTION

This invention relates to a carrier for magnetic brush development which is used for developing an electrostatic latent image in electrophotography, electrostatic recording, and the like. More particularly, it relates to a carrier, for magnetic brush development, comprising a magnetic core material and a resin coating layer, which has excellent charging properties, resistance to surface contamination, mechanical strength, and adhesion between the core material and the coating layer.

BACKGROUND OF THE INVENTION

In general electrophotography, an electrostatic latent image is formed through various means on a photoreceptor comprising a photoconductive substance, such as selenium, and a toner is deposited on the latent image by magnetic brush development, or like technique, to make visible the latent image.

In the aforesaid development processing, particles called "carriers" are used to impose an appropriate quantity of positive or negative charge on toner particles. Carriers are generally divided into coated carriers and non-coated carriers. Because coated carriers have a superior working life in developers, and the like, various kinds have been developed and put into practical use.

Among various performance characteristics required for the carrier, particularly important are proper charging properties, impact resistance, abrasion resistance, satisfactory adhesion between the core and the coating material, uniformity of charge distribution, and the like. Taking these characteristic requirements into consideration, the conventionally known coated carriers still leave room for improvement, and none of them is quite satisfactory. For example, although fluorinated vinyl polymers, proposed as a coating material in U.S. Pat. Nos. 3,922,382 and 3,798,167, satisfy resistance to surface contamination, they have poor adhesion to a magnetic core. Acrylic polymers as described in JP-A-47-13954, though satisfactory in mechanical strength and adhesion to a core, are insufficiently resistive to surface contamination and have poor charging properties. Thus, the state-of-the-art coated carriers employ coating materials having both merits and demerits.

SUMMARY OF THE INVENTION

Accordingly, an object of this invention is an improved carrier for magnetic brush development for use in development of an electrostatic latent image in electrophotography, electrostatic recording, and the like.

Another object of this invention is a carrier for magnetic brush development which exhibits a high rate of charge increase (i.e., a quick charging property) and satisfactory resistance to surface contamination so as to result in no reduction of charge quantity, and thereby prevent fog in the initial stage of running of a developing machine.

A further object of this invention is a carrier for magnetic brush development which has excellent adhesion between the magnetic core material and the coating layer.

These and other objects are accomplished by a carrier for a developer comprising a core material coated with a coating material consisting essentially of a copolymer of vinylidene fluoride and trifluoroethylene or hexafluoropropylene.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE INVENTION

In a preferred embodiment of the present invention, a magnetic core material is coated with the coating material that contains, as an additional component, a homo- or copolymer of an acrylic ester and/or a methacrylic ester, or a copolymer of trifluoromonochloroethylene and vinyl chloride.

The vinylidene fluoride-trifluoroethylene copolymer or vinylidene fluoride-hexafluoropropylene copolymer (hereinafter collectively referred to as "vinylidene fluoride copolymer") which can be used as an essential in the present invention can be obtained by emulsion polymerization or suspension polymerization. The molar ratio of vinylidene fluoride to trifluoroethylene or hexafluoropropylene in the copolymer is preferably from 1:9 to 9:1 and more preferably from 2:8 to 8:2. The vinylidene fluoride copolymer preferably has an intrinsic viscosity ($\eta$) from 0.4 to 1.5.

While the vinylidene fluoride copolymer, even when used alone, exhibits charging properties and coating film characteristics sufficient for use, to increase freedom of charge control and adhesion between the coating material and the core, it is effective to use a homo- or copolymer of an acrylic ester and/or a methacrylic ester (hereinafter referred to as (meth)acrylate polymer), or a trifluoromonochloroethylene-vinyl chloride copolymer, in combination with the vinylidene fluoride copolymer.

A mixing ratio (by weight) of the vinylidene fluoride copolymer to the (meth)acrylate polymer or the trifluoromonochloroethylene-vinyl chloride copolymer usually ranges from 99:1 to 20:80, preferably from 90:10 to 20:80 and more preferably from 80:20 to 20:80. A suitable mixing ratio can be determined in accordance with the rates of charge increase and decrease (decay) of the toner used.

Monomers to be used for preparing the (meth)- acrylate polymer include esters of acrylic acid or methacrylic acid with various alcohols. Specific examples of the ester-forming alcohol include alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, hexadecyl alcohol, etc.); halogenated alkyl alcohols obtained by partial halogenation of these alkyl alcohols; alkoxyalkyl alcohols (e.g., methoxyethyl alcohol, ethoxyethyl alcohol, ethoxyethoxyethyl alcohol, methoxypropyl alcohol, ethoxypropyl alcohol, etc.); aralkyl alcohols (e.g., benzyl alcohol, phenylethyl alcohol, phenylpropyl alcohol, etc.); and alkenyl alcohols (e.g., allyl alcohol, crotonyl alcohol, etc.).

These (meth)acrylate monomers can be used either alone or in combination of two or more thereof. If desired, the (meth)acrylate polymer may further contain another copolymerizable monomer or monomers. In this case, it is preferable that the (meth)acrylate copolymer contains at least 25% by weight, more preferably at least 50% by weight, of the above-described (meth)acrylate monomers.

Monomers that are copolymerizable with the (meth-)acrylate monomers include styrene monomers, such as styrene, alkylstyrenes (e.g., methylstyrene, dimethylstyrene, trimethylstyrene, ethylstyrene, diethylstyrene, triethylstyrene, propylstyrene, butylstyrene, hexylstyrene, heptylstyrene, octylstyrene, etc.), halogenated styrenes (e.g., fluorostyrene, chlorostyrene, bromostyrene, dibromostyrene, iodostyrene, etc.), nitrostyrene, acetystyrene, methoxystyrene, etc.; addition polymerizable unsaturated aliphatic monocarboxylic acids (e.g., acrylic acid, methacrylic acid, α-ethylacrylic acid, crotonic acid, α-methylcrotonic acid, α-ethylcrotonic acid, isocrotonic acid, angelic acid, etc.), and addition polymerizable unsaturated aliphatic dicarboxylic acids (e.g., maleic acid, fumaric acid, itaconic acid, citraconic acid, mesaconic acid, glutaconic acid, dihydromuconic acid, etc.); esters of the above-enumerated addition polymerizable aliphatic carboxylic acids with alcohols, such as alkyl alcohols, halogenated alkyl alcohols, alkoxyalkyl alcohols, aralkyl alcohols, and alkenyl alcohols as described above, amides and nitriles derived from the above-described addition polymerizable unsaturated carboxylic acids; aliphatic mono-olefins (e.g., ethylene, propylene, butene, isobutylene, etc.); halogenated aliphatic olefins (e.g., vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, vinylidene fluoride, etc.); conjugated diene aliphatic diolefins (e.g., 1,3-butadiene, 1,3-pentadiene, 2-methyl-1,3-butadiene, 2,3-dimenthyl-1,3-butadiene, 2,4-hexadiene, 3-methyl-2,4-hexadiene, etc.); vinyl acetates, vinyl ethers, and nitrogen-containing vinyl compounds, such as vinylcarbazole, vinylpyridine, and vinylpyrrolidone, and the like.

In addition, metal salts of the above-recited addition polymerizable unsaturated aliphatic carboxylic acids can also be used as monomer unit. The metal salt formation can be effected after completion of the polymerization.

The (meth)acrylate polymer preferably has a number average molecular weight (Mn) of from 1,000 to 10,000 and more preferably from 3,000 to 8,000.

The trifluoromonochloroethylene-vinyl chloride copolymer, which can be used in combination with the vinylidene fluoride copolymer, can be obtained by emulsion polymerization or suspension polymerization, and it is also commercially available under trademark "FPC-461" from Firestone Co., Ltd.

The core material that can be used in the coated carrier according to the present invention includes magnetic powders commonly employed in the art, such as iron powders, iron oxide powders, iron carbonyl powders, powders of magnetite, nickel or ferrite, and the like. These magnetic powders usually have a particle size of from 10 to 500 μm.

The carrier particles of the present invention can be produced by treating the surface of the core material with the vinylidene fluoride copolymer and, if desired, the (meth)acrylate polymer or the trifluoromonochloroethylene-vinyl chloride copolymer to form a coating layer through chemical bonding or adsorption. More specifically, the coating layer can be formed by a dip coating technique, in which the core material is dipped in a solution of the polymer in an appropriate solvent, the solvent is removed, and the coating layer is dried and optionally baked at high temperatures; or a spray coating technique, in which the aforesaid polymer solution is sprayed onto the core material while moving by a fluidized bed process, dried, and optionally baked at high temperatures.

The coating material according to the present invention is preferably coated in a total amount of from 0.05 to 3.0% by weight, preferably from 0.1 to 2.0% by weight, based on the core material.

The carrier of the present invention is mixed with a toner to prepare a magnetic brush developer for developing an electrostatic latent image.

The toner to be mixed is not particularly restricted and may be any of positively chargeable toners for use in general electrophotography.

Any of known binder resins may be used for the toner. Examples of usable binder resins include homo- or copolymers of styrenes, e.g., styrene, chlorostyrene, vinylstyrene, etc.; mono-olefins, e.g., ethylene, propylene, butylene, isobutylene, etc.; vinyl esters, e.g., vinyl acetate, vinyl propionate, vinyl benzoate, vinyl butyrate, etc.; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers, e.g., vinyl methyl ether, vinyl ethyl ether, vinyl butyl ether, etc.; vinyl ketones, e.g., vinyl methyl ketone, vinyl hexyl ketone, vinyl isopropenyl ketone, etc., and the like. Of these, typically employed binder resins include polystyrene, a styrene/alkyl acrylate copolymer, a styrene/alkyl methacrylate copolymer, a styrene/acrylonitrile copolymer, a styrene/butadiene copolymer, a styrene/maleic anhydride copolymer, polyethylene, polypropylene, polyester, amino-esterified polyester, a styrene/acrylic polyester copolymer, polyurethane, an epoxy resin, a silicone resin, polyamide, modified rosine, paraffin, waxes, etc. Of these, a terminal amino-esterified polyester and a styrene/acrylate copolymer containing less than 50% by weight of styrene is preferred.

Colorants for the toner are conventional, and examples include black colorants, chromatic colorants, and the like. A typical example of the black colorants is carbon black, and examples of the chromatic colorants include copper phthalocyanine type cyan colorants (e.g., C.I. Pigment No. Blue 15-3 and C.I. Pigment No. Blue 15-1), azo type yellow colorants (e.g., C.I. Pigment No. Yellow 97 and C.I. Pigment No. Yellow 12), azo type magnenta colorants (e.g., C.I. Pigment No. Red 5 and C.I. Pigment No. Red 48-2), and quinacridone type magenta colorants (e.g., C.I. Pigment No. Red 122). The colorant can be used independently or as a mixture, and the colorant is generally added in an amount (total) of about 5 to 10% by weight based on the weight of toner.

In the cases where a chromatic colorant is incorporated into the toner, the effects of the present invention become remarkable. It is assumed that the chromatic colorant shows its charge control effects attributed to the molecular structure thereof. In particular, such a tendency is pronounced in the case of using copper phthalocyanine pigments.

The toner according to the present invention may further contain in the binder resin other known additives, such as a positively charged control agents, as described, for example, in JP-A-54-158932 and JP-A-56-11461. In such a case, it should be noted that materials of the binder resin, charge control agent and carrier be chosen so that the toner may be charged positively by friction with the carrier.

The toner in the developer of the present invention generally has an average particle size of not more than about 30 μm, and preferably of from 3 to 20 μm.

The carrier in accordance with the present invention produces various excellent effects as set forth below owing to the use of the specified polymer as a coating material.

1 Since the carrier exhibits a high rate of charge increase and displays no reduction in charge quantity during running, there is no fear of fog, or contamination in the initial stage of running of a developing machine.

2 The carrier exhibits high mechanical strength and excellent adhesion between the core material and the coating layer so that release of the coating layer due to internal destruction does not occur.

3 The carrier is prevented from contamination because of its low surface energy to prolong the working life of the developer.

4 The carrier can be produced simply by dip coating or spray coating of a core material with a polymer solution and, if desired, by heating.

The present invention is now illustrated in greater detail with reference to Examples and Comparative Examples, but it should be understood that the present invention is not deemed to be limited thereto. In these Examples, all the parts and ratios are by weight unless otherwise indicated.

EXAMPLE 1

In 100 parts of dimethylformamide were dissolved 16 parts of a vinylidene fluoride-trifluoroethylene copolymer (monomer ratio: about 8/2; intrinsic viscosity $[\eta]=1.2$) and 4 parts of polymethyl methacrylate having a number average molecular weight (Mn) of 5,000, and the resulting polymer solution was coated on 2,000 parts of a spherical iron oxide powder having an average particle size of 100 μm by means of a vacuum kneader coating apparatus to obtain a carrier.

COMPARATIVE EXAMPLE 1

A carrier was produced in the same manner as in Example 1, except for replacing the vinylidene fluoride-trifluoroethylene copolymer with polyvinylidene fluoride ("KF #1000" produced by Kureha Chemical Co., Ltd.; $[\eta]=1.0$).

COMPARATIVE EXAMPLE 2

A carrier was produced in the same manner as in Example 1, except for changing the amounts of the vinylidene fluoride copolymer and the polymethyl methacrylate to 3 parts and 17 parts, respectively.

EXAMPLE 2

Seven parts of the same vinylidene fluoride-trifluoroethylene copolymer, as used in Example 1, and 13 parts of a trifluoromonochloroethylene-vinyl chloride copolymer ("FPC-461" produced by Firestone Co., Ltd.) were dissolved in 80 parts of dimethylformamide, and the resulting polymer solution was coated on 2,000 parts of a ferrite powder having an average particle size of 60 μm by means of a fluidized bed coating apparatus to obtain a carrier.

EXAMPLE 3

In 100 parts of dimethylformamide were dissolved 10 parts of a vinylidene fluoride-hexafluoropropylene copolymer (monomer ratio: about 8/2; intrinsic viscosity $[\eta]=1.0$) and 10 parts of polymethyl methacrylate (Mn=5,000), and the resulting polymer solution was coated on 2,000 parts of a spherical iron oxide powder having an average particle size of 100 μm by means of a fluidized bed coating apparatus to obtain a carrier.

COMPARATIVE EXAMPLE 3

A carrier was produced in the same manner as in Example 3, except for replacing the vinylidene fluoride-hexafluoropropylene copolymer with polyvinylidene fluoride ("KF #1000"; $[\eta]=1.0$).

COMPARATIVE EXAMPLE 4

A carrier was produced in the same manner as in Example 3, except for changing the amounts of the vinylidene fluoride copolymer and the polymethyl methacrylate to 2 parts and 18 parts, respectively.

EXAMPLE 4

Ten parts of the same vinylidene fluoride-hexafluoropropylene copolymer, as used in Example 3, and 10 parts of a tri-fluoromonochloroethylene-vinyl chloride copolymer ("FPC-461") were dissolved in 300 parts of methyl ethyl ketone, and the resulting polymer solution was coated on 2,000 parts of a ferrite powder having an average particle size of 60 μm by means of a fluidized bed coating apparatus to obtain a carrier.

A thousand parts of each of the carriers obtained in Exampled 1 to 4 and Comparative Examples 1 to 4 was mixed with 30 parts of a positively chargeable toner comprising a styrene-butyl acrylate copolymer, carbon black, and a Nigrosine charge control agent ("Bontron N-04" produced by Orient Chemical Co., Ltd.) to prepare a developer.

The developer was loaded in a Xerox 1065 (OPC belt-carrying copying machine sold in the U.S.A. and Europe), and a continuous running test was carried on. The results of the test are shown in the Table below. In the Table, the quantity of charge of the toner was measured by means of a blow-off measuring equipment; the release of the coating material was observed under a scanning electron microscope; and the life of the developer was evaluated by the number of copies obtained by the time when the density of the image area corresponding to the original having a density of 1.0 decreased to 0.7 or less and the fog density on the white background increased to 0.03 or more.

TABLE

| Example No. | Initial Charge Quantity (μC/g) | Charge Quantity After Running 100,000 Times (μC/g) | Contamination of Developing Machine | Peeling of Coating Material | Life of Developer |
|---|---|---|---|---|---|
| Example 1 | 24 | 16 | not observed | slight | 100,000 copies or more |
| Comparative Example 1 | 23 | 5 | observed | extensive | 20,000 copies |
| Comparative | 12 | 9 | " | slight | 40,000 copies |

TABLE-continued

| Example No. | Initial Charge Quantity (μC/g) | Charge Quantity After Running 100,000 Times (μC/g) | Contamination of Developing Machine | Peeling of Coating Material | Life of Developer |
|---|---|---|---|---|---|
| Example 2 | | | | | |
| Example 2 | 25 | 18 | not observed | " | 100,000 copies or more |
| Example 3 | 23 | 20 | " | " | 100,000 copies or more |
| Comparative Example 3 | 27 | 7 | observed | extensive | 20,000 copies |
| Comparative Example 4 | 7 | 10 | " | slight | 50,000 copies |
| Example 4 | 27 | 18 | not observed | " | 100,000 copies or more |

Additional advantages and modifications will readily occur to those skilled in the art. The invention in its broader aspects is, therefore, not limited to the specific details, and illustrative example shown and described. Accordingly, departures may be made from such details without departing from the spirit or scope of the general inventive concept as defined by the appended claims and their equivalents.

What is claimed is:

1. A carrier for a developer comprising a core material coated with a coating material consisting essentially of a copolymer of vinylidene fluoride and trifluorethylene.

2. A carrier as claimed in claim 1, wherein said copolymer of vinylidene fluoride and trifluorethylene has a molar ratio in the range of 1:9 to 9:1.

3. A carrier as claimed in claim 1, wherein said copolymer of vinylidene fluoride and trifluorethylene has a molar ratio in the range of 2:8 to 8:2.

4. A carrier as claimed in claim 1, wherein said copolymer of vinylidene fluoride and trifluorethylene has an intrinsic viscosity in the range of 0.4 to 1.5.

5. A carrier as claimed in claim 1, wherein said coating material further contains a homo- or copolymer of an acrylic ester and/or a methacrylic ester at a weight ratio of said copolymer of vinylidene fluoride and trifluoroethylene to said homo- or copolymer in the range of 99:1 to 20:80.

6. A carrier as claimed in claim 1, wherein said coating material further contains a homo- or copolymer of an acrylic ester and/or a methacrylic ester at a weight ratio of said copolymer of vinylidene fluoride and trifluoroethylene to said homo- or copolymer in the range of 90:10 to 20:80.

7. A carrier as claimed in claim 1, wherein said coating material further contains a homo- or copolymer of an acrylic ester and/or a methacrylic ester at a weight ratio of said copolymer of vinylidene fluoride and trifluoroethylene to said homo- or copolymer in the range of 80:20 to 20:80.

8. A carrier as claimed in claim 1, wherein said coating material is coated in an amount in the range of 0.05 to 3.0% by weight based on the core material.

9. A carrier as claimed in claim 1, wherein said coating material is coated in an amount in the range of 0.1 to 2.0% by weight based in the core material.

10. A carrier as claimed in claim 1, wherein said core material is magnetic.

11. A carrier for a developer comprising a core material coated with a coating material consisting essentially of a copolymer of vinylidene fluoride and trifluoroethylene and a copolymer of trifluoromonochloroethylene and vinyl chloride at a ratio of said copolymer of vinylidene fluoride and trifluoroethylene to said copolymer of trifluoromonochloroethylene and vinyl chloride in the range of 99:1 to 20:80.

12. A carrier as claimed in claim 11, wherein said coating material further contains a copolymer of trifluoromonochloroethylene and vinyl chloride at a ratio of said copolymer of vinylidene fluoride and trifluoroethylene to said copolymer of trifluoromonochloroethylene and vinyl chloride in the range of 90:10 to 20:80.

13. A carrier as claimed in claim 11, wherein said coating material further contains a copolymer of the trifluorochloroethylene and vinyl chloride at a ratio of said copolymer of vinylidene fluoride and trifluoroethylene to said copolymer of trifluoromonochloroethylene and vinyl chloride in the range of 80:20 to 20:80.

* * * * *